United States Patent [19]

Nishikawa et al.

[11] 4,179,673

[45] Dec. 18, 1979

[54] INTERDIGITAL FILTER

[75] Inventors: Toshio Nishikawa, Nagaokakyo; Youhei Ishikawa; Sadahiro Tamura, both of Kyoto; Haruo Matsumoto, Nagaokakyo, all of Japan

[73] Assignee: Murata Manufacturing Co., Ltd., Kyoto, Japan

[21] Appl. No.: 876,247

[22] Filed: Feb. 9, 1978

[30] Foreign Application Priority Data

Feb. 14, 1977 [JP] Japan ..... 52/15204
Jul. 6, 1977 [JP] Japan ..... 52/81429

[51] Int. Cl.[2] ..... H01P 1/20
[52] U.S. Cl. ..... 333/204; 333/202
[58] Field of Search ..... 333/73 R, 73 C, 73 S, 333/73 W

[56] References Cited

U.S. PATENT DOCUMENTS

| | | | |
|---|---|---|---|
| 3,327,255 | 6/1967 | Bolljahn et al. | 333/73 R |
| 3,408,599 | 10/1968 | Horton et al. | 333/73 R |
| 3,460,074 | 8/1969 | Kurzl et al. | 333/73 R |
| 3,505,618 | 4/1970 | McKee | 333/73 R |

*Primary Examiner*—Alfred E. Smith
*Assistant Examiner*—Harry E. Barlow
*Attorney, Agent, or Firm*—Birch, Stewart, Kolasch & Birch

[57] ABSTRACT

An interdigital filter comprising a plurality of resonators each comprising a resonant conductor rod coupled to each other in the even and odd modes of a transverse electromagnetic wave, wherein each resonant conductor rod is enclosed with a dielectric material so as to increase the ratio of the odd mode characteristic impedance to the even mode characteristic impedance.

11 Claims, 13 Drawing Figures

INTERDIGITAL FILTER

BACKGROUND OF THE INVENTION

1. Field of the Invention

The present invention relates to an interdigital filter, and more specifically to an interdigital band-pass filter comprising a plurality of resonators coupled in the even and odd modes of a transverse electromagnetic wave.

2. Description of the Prior Art

Interdigital band-pass filters have been utilized in transmitters, for example, because of the high quality factor Q thereof. Such an interdigital filter utilizes a plurality of resonators coupled to each other not in the harmonic modes but in the even odd modes of the transverse electromagnetic wave.

FIGS. 1A and 1B show an example of a prior art interdigital band-pass filter, wherein FIG. 1A shows a plan view of the filter with a cover removed and FIG. 1B shows a sectional view of the filter taken along the line IB—IB. Such prior art filters may be seen, for example, in pages of the book entitled "Microwave Filters, Impedance-Matching Networks, and Coupling Structures" published by Mcgraw-Hill Book Company. Referring to FIGS. 1A and 1B, upper and lower conductor plates 1 and 2 are kept in parallel with each other spaced apart from each other by the distance H. The upper and lower conductor plates 1 and 2 may be made of a metal plate such as an aluminum plate and serve as a ground conductor. Metal spacers 1*a* are provided on the lower surface of the upper conductor plate 1 at both sides i.e. the upper and lower sides of the upper conductor plate, as viewed in FIG. 1A and metal spacers 2*a* are provided on the upper surface of the lower conductor plate 2 at both sides, i.e. the upper and lower sides of the lower conductor plate 2 as viewed in FIG. 1A. A plurality of resonant conductor rods 3, 3, 3 . . . are provided between the metal spacers 1*a* and 2*a* so as to extend alternately from either side of the conductor plates 1*a* and 2*a* in the transversal direction of the conductor plates 1 and 2 with a predetermined distance d from each other. The length of the resonant conductor rods 3, 3, 3 . . . is selected to be l which is shorter than the width L between the spacers at both sides. As a result, a cut-off space 9 is formed between the terminal end of the resonant conductor rod 3 and the metal spacers in the opposite side of the conductor plates 1*a* and 2*a*. Thus, the resonant conductor rod 3, 3, 3 . . . are arranged in the so-called interdigital manner, as seen in FIG. 1A. Referring further to FIG. 1A, an input coupler 41 is provided in parallel with and in the vicinity of the left end resonant conductor rod 3 as viewed in FIG. 1A, while an output coupler 42 is provided in parallel with and in the vicinity of the right end resonant conductor rod 3 as viewed in FIG. 1A. The input coupler 41 is coupled to an input coaxial connector 51 through an impedance matching terminal, while an output coupler 42 is coupled to an output coaxial connector 52 through an impedance matching terminal. Such an arrangement is packed to provide a complete interdigital filter 10. As is well known, the resonant conductor rods 3, 3, 3 . . . are coupled to each other in the even and odd modes of the transverse electromagnetic wave in such an interdigital filter 10. As a result, the interdigital filter 10 exhibits a resonance characteristic as shown in FIG. 2, wherein the ordinate shows an attenuation and the abscissa shows the frequency.

Such is interdigital filter 10 as described in the foregoing was not able to be made compact, because the distance H, the width L and the length W were not able to be made small due to a restriction to a requirement in terms of the characteristics of the filter. Generally, it is required that such a filter be of a high quality factor Q which makes it difficult to make the effective distance H smaller than a predetermined value, inasmuch as a decreased distance H decreases the quality factor of the filter. In addition, if the distance d between the adjacent resonators and thus the resonant conductor rods 3 becomes too small, the degree of mutual coupling of the resonators become too large, which makes too broad the band width of the frequency characteristic of the filter. Furthermore, the width L is restricted because of the inherent length l of the resonant conductor rod 3 and the cut-off space at the open end of the resonant conductor rod. A filter of a narrow band width could be provided by decreasing the degree of the mutual coupling between the resonant conductor rods. In such a situation, however, it is necessary to increase the distance d and thus the length W, which degrades a temperature characteristic although the quality factor remains high. More specifically, it could happen that if the band width is made narrow the central frequency fo could vary greatly by virtue of the temperature variation. Thus, in spite of a demand for a compact interdigital filter, there has been difficulty in miniaturizing such a prior art interdigital filter. Accordingly, this difficulty to in miniaturizing of such interdigital filters has been a hindrance to compactness of the whole system where such interdigital filter is utilized.

SUMMARY OF THE INVENTION

Brifely described, the present invention comprises an interdigital filter including a plurality of resonators each being enclosed with a dielectric material, with a spacing provided therebetween or a low dielectric material inserted therebetween, thereby to modifying the ratio of the characteristic impedance.

Therefore, a principal object of the present invention is to provide a compact interdigital filter, wherein the above described difficulty in achieving compactness has been eliminated.

Another object of the present invention is to provide an improved interdigital filter, wherein a plurality of resonant conductor rods are arranged, with each being enclosed with a dielectric material and with a low dielectric material portion being formed between the adjacent resonators.

A further object of the present invention is to provide an improved interdigital filter, wherein the degree of mutual coupling between two adjacent resonators therein can be selected as desired with ease.

Still a further object of the present invention is to provide an improved interdigital filter, wherein a temperature characteristic has been stabilized.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
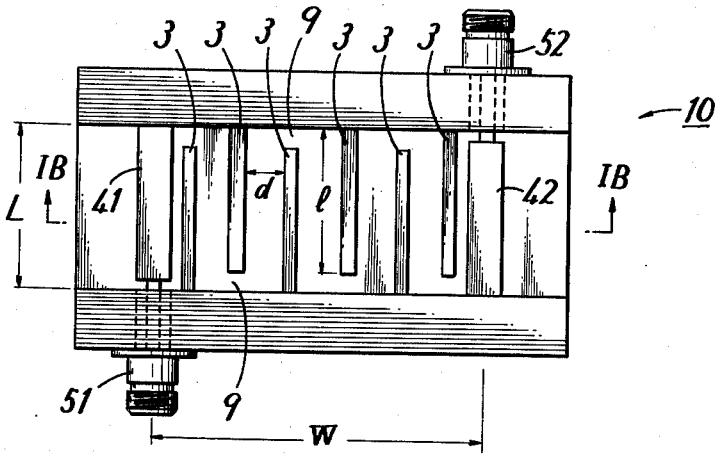
FIG. 1A PRIOR ART
FIG. 1A shows a plan view of a prior art interdigital filter, with a cover removed.
Figure 1B:
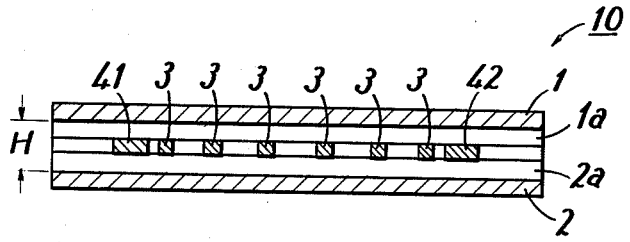
FIG. 1B PRIOR ART
FIG. 1B shows a sectional view of the FIG. 1 filter taken along the line IB—IB in FIG. 1A.
Figure 2:
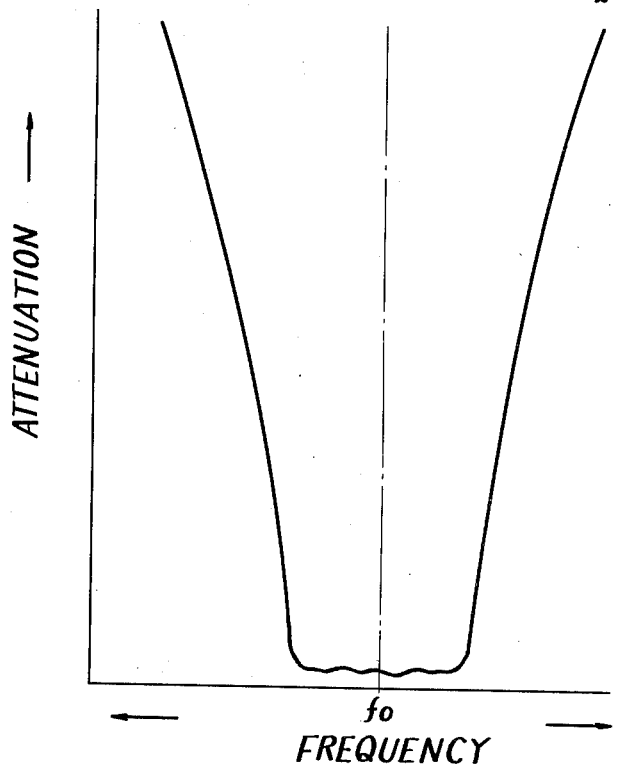
FIG. 2 PRIOR ART
FIG. 2 shows a frequency characteristic of the FIG. 1 filter.
Figure 3A:
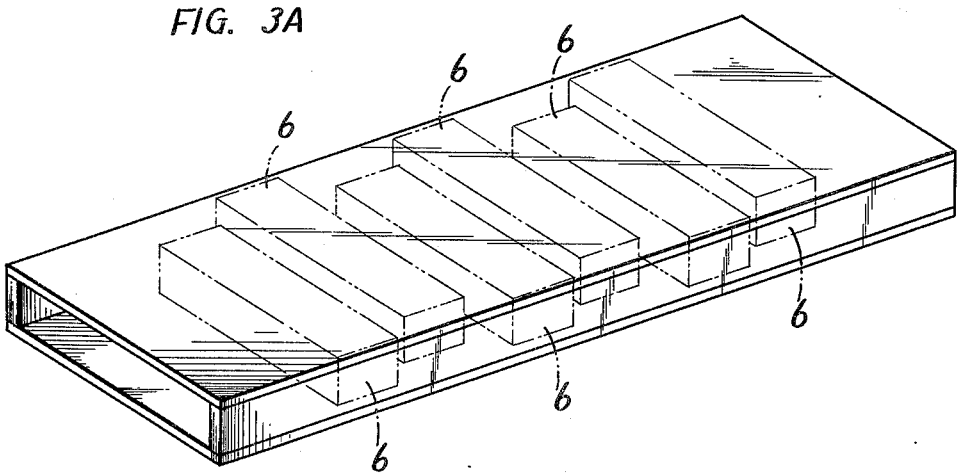
FIG. 3A shows a perspective view of an interdigital filter of one embodiment of the present invention.
Figure 3B:
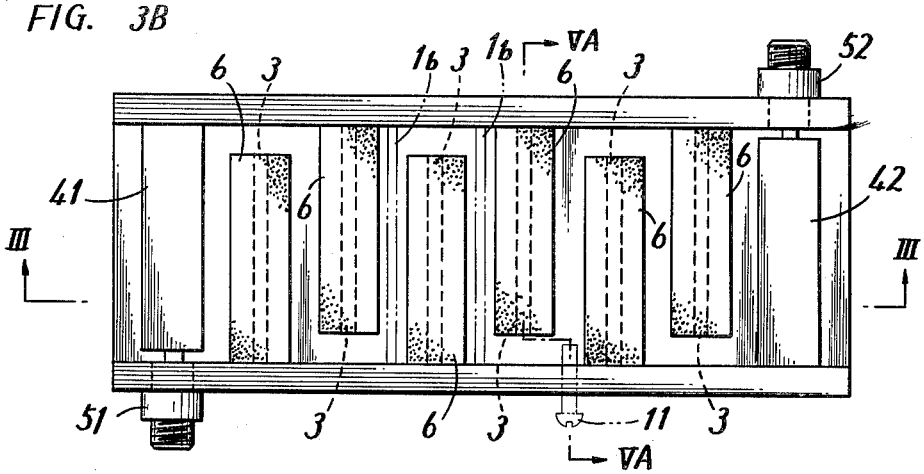
FIG. 3B is similar to FIG. 1A but shows a plan view of the FIG. 3A filter, with a cover removed.
Figure 3:
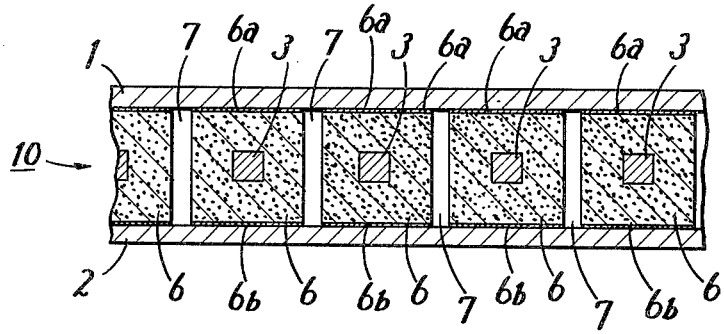
FIG. 3 shows a sectional view of the FIG. 3A filter, taken along the line III—III in FIG. 3B.

FIG. 3A shows a perspective view of an interdigital filter in accordance with the present invention, FIG. 3B shows a plan view of the FIG. 3A filter, with a cover removed, and FIG. 3 shows a sectional view of the inventive filter taken along the line III—III in FIG. 3B. The embodiment shown comprises the upper and lower conductor plates 1 and 2, and a plurality of resonant conductor rods 3, 3, 3 . . . arranged between the upper and the lower conductor plates 1 and 2 so as to extend alternately from either side of the conductors 1 and 2 in the transversal direction with a predetermined distance from each other. Each of the resonant conductor rods is covered with a dielectric material block 6 the dielectric material comprising a titanium oxide group ceramic or forsterite. The dielectric material block 6 is shaped in a square parallelepiped. An electrode **6*a* is formed on the top surface of the dielectric material block 6 and another electrode 6*b* is formed on the bottom surface of the dielectric material block 6. These electrodes 6*a* and 6*b* are in electrical contact with the upper and the lower conductor plates 1 and 2 in the assembled state. In order to improve such electrical contact, the dielectric material block 6 formed with the electrodes 6*a* and 6*b* may be fired in an electric furnace. Such a combination of one resonant conductor rod 3 and the dielectric material 6 constitutes a single resonator. In the embodiment shown, such resonators are arranged so as to be coupled to each other in the even and odd modes. In the embodiment shown, these resonators are arranged with a spacing 7** between two adjacent resonators.

In accordance with the present invention, each of the the resonant conductor rods 3, 3, 3 . . . is surrounded by or enclosed with the corresponding dielectric material blocks 6, 6, 6 . . . of a square parallelepiped. As a result, the characteristic impedance Zo, i.e. the characteristic impedance Zoo for the odd mode and the characteristic impedance Zoe for the even mode, between the respective adjacent resonators becomes small as a whole. On the other hand, enclosing the respective resonant conductor rods with a dielectric material increases the degree of mutual coupling between the adjacent resonators. Therefore, if and when the respective resonant conductor rod is simply covered with a dielectric material, only the length l of the resonant conductor rod 3 can be made small, assuming that a quarter wave resonator of the same characteristic is to be constituted. On the contrary, however, the degree of mutual coupling is increased, which necessitates broadening of the distance d between the adjacent resonant conductor rods, with the result that the length W may be increased. In accordance with the present invention, therefore, the above described spacing 7 is formed, in order to decrease the degree of mutual coupling between the adjacent resonators and thus in order to make the same or to make narrow the band width which is dependent on the coupling. Thus, the fact that each resonator is formed in a dielectric resonator and a spacing is formed between adjacent resonators decreases the degree of mutual coupling of the resonators.

In general, the degree of coupling is determined by the ratio of the characteristic impedance Zoo in the odd mode of the transverse electromagnetic wave to the characteristic impedance Zoe in the even mode of the transverse electromagnetic wave. Therefore, if and when the above described spacing 7 is formed between the adjacent resonators, only the even mode characteristic impedance Zoe is decreased while the odd mode characteristic impedance Zoo is not substantially changed, with the result that the ratio can be increased as a whole. Accordingly, the degree of coupling which is dependent on the ratio of the characteristic impedances is decreased and thus the band width becomes narrow. This means that if and when the same band width characteristic is maintained the distance d between the adjacent resonator conductor rods can be decreased and if and when the same distance d is maintained the band width can be narrowed. Furthermore, since the resonator is formed with a dielectric material, an adverse affect of the coefficient of linear expansion of the respective metalic conductors can be eliminated by properly selecting the temperature coefficient of the dielectric material 6, with the result that the temperature characteristic of the filter is extremely improved Accordingly, even if the filter is implemented in a narrower band width, there is no fluctuation of the resonance frequency and hence a stabilized operation can be achieved.

Figure 4:
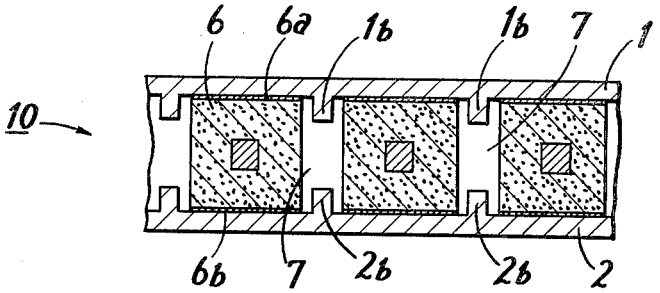
FIG. 4 is similar to FIG. 3 but shows a sectional view of another embodiment of the present invention.

FIG. 4 shows a sectional view of another embodiment of the present invention. In comparison with the FIG. 3 embodiment, the embodiment shown in FIG. 4 has protuberances **1*b* and 2*b* protruded from the upper and lower conductor plates 1 and 2 at the position of the spacing 7 for the purpose of adjusting the degree of mutual coupling between the adjacent resonators. Since the remaining portions in the FIG. 4 embodiment are the same as those depicted in FIG. 3, it is not believed necessary to describe them again in more detail. Since the protuberances 1*b* and 2*b* formed at the position of the spacing 7** achieves adjustment of the degree of mutual coupling, the distance between the adjacent resonators can be further decreased.

Figure 5A:
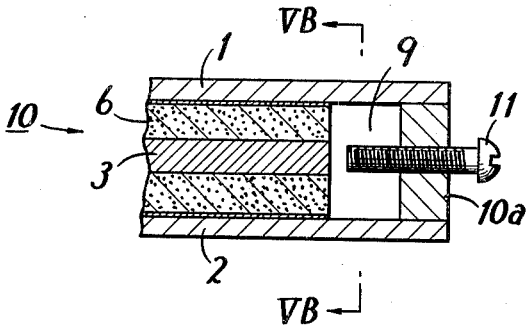
FIG. 5A shows a sectional view of a further embodiment of the present invention taken along the line VA—VA in FIG. 3B.
Figure 5B:
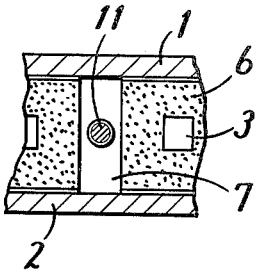
FIG. 5B shows a sectional view of the FIG. 5A embodiment taken along the line VB—VB in FIG. 5A.

FIG. 5A shows a sectional view of a further embodiment of the present invention taken along the line VA—VA in FIG. 3B and FIG. 5B shows a sectional view of the FIG. 5A embodiment taken along the line VB—VB in FIG. 5A. The embodiment shown comprises a coupling adjusting screw 11 provided through a rear cover **10*a* of the package of the filter 10 such that the screw 11 is protruded into the cut-off space 9 of the resonator at the position intermediate the adjacent resonators. According to the embodiment shown, the degree of mutual coupling between the adjacent resonators can be adjusted as desired as a function of the amount of protrusion of the screw 11 into the cut-off space 9 at the position intermediate the adjacent resonators. Accordingly, the embodiment shown in FIGS. 5A and 5B may be employed also in the FIG. 4** embodiment.

Figure 6:
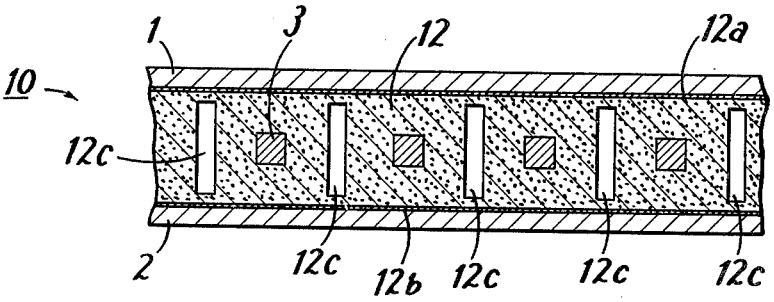
FIG. 6 is similar to FIG. 3 but shows a sectional view of still a further embodiment of the present invention.

FIG. 6 shows a sectional view of still a further embodiment of the present invention. In comparison with the embodiments described in the foregoing, the FIG. 6 embodiment comprises a dielectric material 12 which is integrally formed to the respective resonators such that each of the resonant conductor rods 3 is covered with the dielectric material 12 at the corresponding portions. Such continuous dielectric block 12 is provided with conductor plates 12*a* and 12*b* on the upper and lower surfaces of the dielectric material 12, by means of a firing process of a silber paste for example, whereby the conductor plates 12*a* and 12*b* are in electrical contact with the corresponding conductors 1 and 2 in the completed filter. One feature to be noted in the FIG. 6 embodiment is that the gaps 12*c* are formed at the positions intermediate the adjacent resonators so as to correspond to the spacings 7 in the embodiments described previously. It has been observed that an integral dielectric material block common to all the resonators with the gaps 12*c* formed at the positions intermediate the adjacent resonators also provides substantially the same characteristic as that attained in the embodiments described previously. According to the FIG. 6 embodiment, the dielectric material block 12 can be fabricated as a single block, which simplifies the manufacturing process.

In the embodiments described in the foregoing, a gap or a spacing was formed in the dielectric material covering the resonant conductor rods at the position intermediate the adjacent resonators, in order to form a low dielectric portion therein. Alternatively, however, separate dielectric pieces having a smaller dielectric coefficient may be inserted in such gap or spacing. It is further pointed out that the embodiments described in conjunction with FIGS. 3 through 6 may be properly combined in practicing the present invention.

Figure 7:
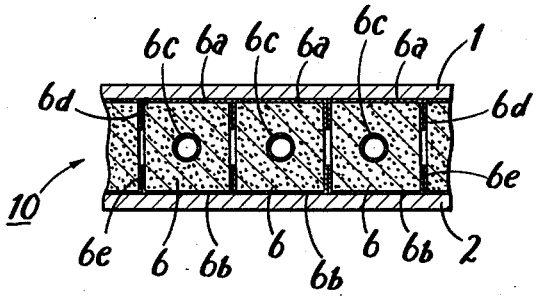
FIG. 7 is again similar to FIG. 3 but shows a sectional view of still a further embodiment of the present invention.
Figure 8:
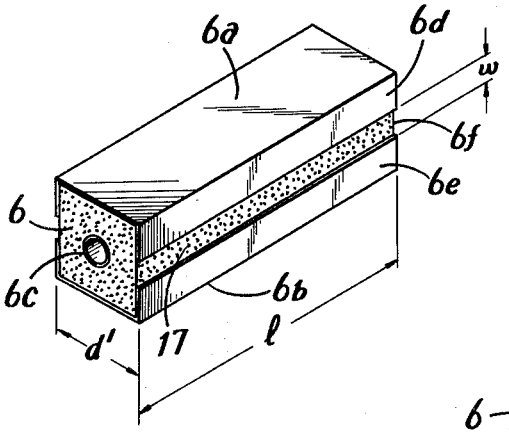
FIG. 8 is a perspective view of one dielectric resonator for use in the FIG. 7 embodiment.

FIG. 7 shows a sectional view of still a further embodiment of the present invention and FIG. 8 shows a perspective view of only a single resonator for use in the FIG. 7 embodiment. In comparison with the FIG. 3 embodiment, the embodiment shown in FIGS. 7 and 8 includes the following features. One feature to be noted is that side wall electrodes 6*d* and 6*e* are formed on the side surfaces such that the side surface electrode 6*d* is in electrical contact with the upper electrode 6*a* and the side surface electrode 6*e* is in electrical contact with the lower electrode 6*b*, while an opening 17 of the width w is formed therebetween in the horizontal direction as viewed in FIG. 8. The opening 17 formed between the side surface electrodes 6*d* and 6*e* functions as an opening for mutual coupling of the adjacent resonators in the even and odd modes. Another feature to be noted in the FIGS. 7 and 8 embodiment is that a plurality of the electric resonators 6 are arranged so as to be contiguous to each other at the side surface electrodes 6*d* and 6*e*. In the embodiment shown, the mutual coupling between the adjacent dielectric resonators is achieved through the above described coupling opening 17 and the degree of coupling is determined as a function of the width w of the above described coupling opening 17.

A further feature to be noted in the FIGS. 7 and 8 embodiment is that the dielectric material block 6 is formed of a central bore or aperture extending in the longitudinal direction of the resonator means and the resonant conductor is implemented as a hollow conductor layer 6*c* formed on the inner wall of the central aperture.

The length l of the respective electric resonator is selected to be a quarter or a half of the wave length of the electromagnetic wave. If the length l of the dielectric resonator 6 is selected to be a quarter of the wave length, a short circuit electrode 6*f* is formed at the short circuit end of the resonator 6.

According to the embodiment shown in FIGS. 7 and 8, mutual coupling between the adjacent dielectric resonators is achieved through a coupling opening 17 formed on the side surfaces of the respective resonators, which enables arrangement of the resonators without such a gap between the adjacent dielectric resonators as seen in the embodiments shown in FIGS. 3 through 6. As a result, the length in the longitudinal direction of the inventive interdigital filter can be made small.

Figure 9:
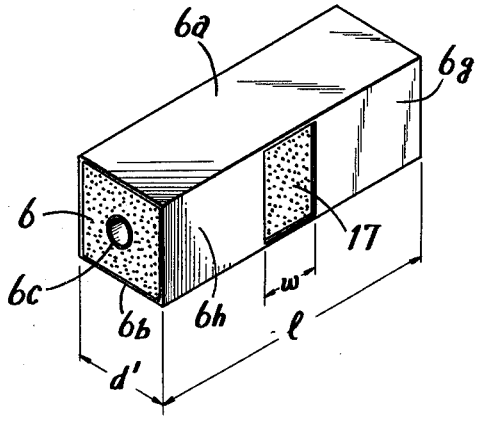
FIG. 9 is a perspective view of another embodiment of the dielectric resonator for alternative use in the FIG. 7 embodiment.

FIG. 9 is similar to FIG. 8 but shows a perspective view of a single dielectric resonator of another embodiment for alternative use in the FIG. 7 embodiment. In comparison with the FIG. 8 embodiment, the FIG. 9 embodiment has the side surface electrodes 6*g* and 6*h* formed on the side surface at the left and right end portions, with a similar coupling opening, 17 formed therebetween extending in the vertical direction as viewed in FIG. 9, although the FIG. 8 embodiment has the side surface electrodes 6*d* and 6*e* formed on the side surface at the upper and lower end portions, with a coupling opening 17 formed therebetween extending in the horizontal direction as viewed in FIG. 8. Because of a similar structure of the coupling opening, substantially the same effect is achieved by the FIG. 9 embodiment as that described in conjunction with the FIG. 8 embodiment.

Although the embodiments shown in FIGS. 7 through 9 were described as adapted such that the degree of coupling is adjusted as desired by adjusting the width w of the coupling opening 17 for mutual coupling between the adjacent dielectric resonators, alternatively the width d' of the respective resonators may be selected for the purpose of adjustment of the degree of coupling, while the width w is kept constant. If desired, the FIGS. 8 and 9 embodiments may be employed simultaneously.

In forming the above described side surface electrodes as well as the upper and lower electrodes, a silber paste deposited on a ceramic in a predetermined pattern may be fired, or alternatively an electrode layer formed on the whole surface may be removed to form the coupling opening in a chemical manner, i.e. by means of a photoetching process, for example, or in a mechanical manner.

Although the present invention has been described and illustrated in detail, it is to be clearly understood that the same is by way of illustration and example only and is not to be taken by way of limitation, the spirit and scope of the present invention being limited only by the terms of appended claims.

What is claimed is:

1. An interdigital filter, comprising casing means of an electrically conductive material said casing means having an inner upper and an inner lower opposing surface, a plurality of dielectric resonator means protruding inwardly from each of the side surfaces of said casing means, said plurality of resonator means being interdigitally arranged relative to each other and extending in a direction perpendicular to said side surfaces, each of said plurality of resonator means comprising a core resonant conductor member and a solid dielectric member disposed to continuously enclose said core resonant conductor member along substantially the entire length of said member, each of said solid dielectric members which comprise each of said plurality of resonator means having a conductive layer formed on the upper surface of said solid dielectric member and formed on the lower surface of said solid dielectric member, said conductive layer on the upper surface of said dielectric member being in contact with said inner upper opposing surface of said casing means, said conductive layer on the lower surface of said dielectric member being in contact with said inner lower opposing surface of said casing means, the adjacent resonator means being coupled in the even and odd modes of the transverse electromagnetic wave, the coupling of said adjacent resonator means causing the ratio of the characteristic impedance in the odd mode to the characteristic impedance in the even mode of said resonator means to increase, a further dielectric portion having a lower dielectric constant relative to the dielectric constant of said solid dielectric member being formed between adjacent ones of said plurality of resonator means, said resonator means being further connected to an input and an output connector means.

2. An interdigital filter in accordance with claim 1, wherein a spacing is formed between the adjacent resonator means said spacing containing said further dielectric portion.

3. An interdigital filter in accordance with claim 2, wherein a protrusion is formed between each of said plurality of dielectric resonator means, said protrusion extending orthogonally from said casing means toward said spacing for adjusting the degree of mutual coupling between the adjacent resonator means, said protrusion extending transversely in a direction substantially parallel to said core resonant conductor members.

4. An interdigital filter in accordance with claim 1, wherein each resonator means extends from one of said side walls toward the other of said side walls and is terminated before said other side wall, thereby to form a cut-off space between the terminating end of said resonator means and said other side wall, and at least one means for adjusting the degree of coupling between adjacent resonator means is provided in said cut-off space at the position intermediate the adjacent resonator means.

5. An interdigital filter in accordance with claim 1, wherein said dielectric member of each resonator means is, in part, integrally connected with each other.

6. An interdigital filter in accordance with claim 1, wherein said resonant conductor member comprises a solid conductor rod.

7. An interdigital filter in accordance with claim 1, wherein said dielectric member includes an aperture formed and extending in the axial direction of said resonator means, and said resonant conductor member comprises a hollow conductor layer formed on the inner wall of said aperture.

8. An interdigital filter in accordance with claim 1, wherein said dielectric member is made of ceramic.

9. An interdigital filter in accordance with claim 1, wherein said dielectric member is of forsterite.

10. An interdigital filter in accordance with claim 1, wherein said conductor layer further extends onto the side surfaces of said solid dielectric member so as to define a coupling opening for adjusting the degree of coupling between adjacent ones of said resonator means.

11. An interdigital filter in accordance with claim 10, wherein said resonator means are arranged such that said conductor layers extend onto the side walls of said solid dielectric member and are in electrical contact with each other.

* * * * *